United States Patent [19]

Alack

[11] Patent Number: 4,848,975

[45] Date of Patent: Jul. 18, 1989

[54] HOPPER SYSTEM AND CLAMPING ARRANGEMENT FOR A PERMEABLE MEMBRANE

[75] Inventor: Charles S. Alack, St. Louis, Mo.

[73] Assignee: Semi-Bulk Systems, Inc., St. Louis, Mo.

[21] Appl. No.: 108,265

[22] Filed: Oct. 13, 1987

[51] Int. Cl.[4] ..... B65G 53/38

[52] U.S. Cl. ..... 406/138; 406/91; 406/134; 406/145

[58] Field of Search ..... 406/134, 135, 136, 137, 406/138, 145, 91, 86, 89, 90, 92; 366/101, 106, 107; 222/195; 209/910, 244, 245, 222; 210/481, 232, 237, 238; 285/240, 242, 252, 253; 403/24, 25, 338; 15/352; 38/102.1, 102.91; 242/74.1

[56] References Cited

U.S. PATENT DOCUMENTS

| | | | |
|---|---|---|---|
| 2,924,487 | 2/1960 | Stambera | 302/29 |
| 3,115,369 | 12/1963 | Bozich | 302/28 |
| 3,173,725 | 3/1965 | Dietert | 302/53 |
| 3,253,750 | 5/1966 | Paton | 222/195 |
| 3,448,900 | 6/1969 | Jakobsson et al. | 406/91 |
| 4,081,110 | 3/1978 | Evans | 222/203 |
| 4,383,766 | 5/1983 | Eriksson | 366/106 |
| 4,591,075 | 5/1986 | Eriksson | 406/90 X |

OTHER PUBLICATIONS

MAC/Colt-On Pneumatics, "Fluidizer Bed," p. 102, Jan. 15, 1982, Sabetha, Kan.

C. R. Daniels, Inc., "Dandux Ayre-Flow Membrane," p. 1, Ellicott City, Md.

Monitor Manufacturing, "Monitor Aeration Devices," p. 1-11, Elburn, Ill.

*Primary Examiner*—Joseph F. Peters, Jr.

*Assistant Examiner*—Gregory R. Poindexter

*Attorney, Agent, or Firm*—Senniger, Powers, Leavitt & Roedel

[57] ABSTRACT

A hopper system comprising a hopper having a side wall sloping downwardly and radially inwardly from the inlet at the top of the hopper to the outlet at the bottom of the hopper. Secured to the inside of the hopper is a membrane having a shape generally conforming to the inside of the hopper and closely overlying the conical side wall of the hopper. The membrane is permeable to air but generally impermeable to fluent material in the hopper and has a plurality of pockets for receiving stay bars. The upper and lower cylindric ends of the membrane are clamped to clamping assemblies mounted on the inside of the hopper adjacent its upper and lower ends, respectively, without the use of fasteners extending through holes in the ends of the membrane or other means of attachment to the hopper. The clamping assemblies are removable from the hopper without first unclamping the membrane whereby the clamping assemblies and membrane may be readily installed in and removed from the hopper. Pressurized air is introduced into the hopper through the hopper walls and passes inwardly through the membrane with the stay bars in the membrane preventing substantial inward billowing. After passing through the membrane, the air enters into fluent material contained within the hopper thereby to fluidize the material for efficient unloading from the hopper.

20 Claims, 4 Drawing Sheets

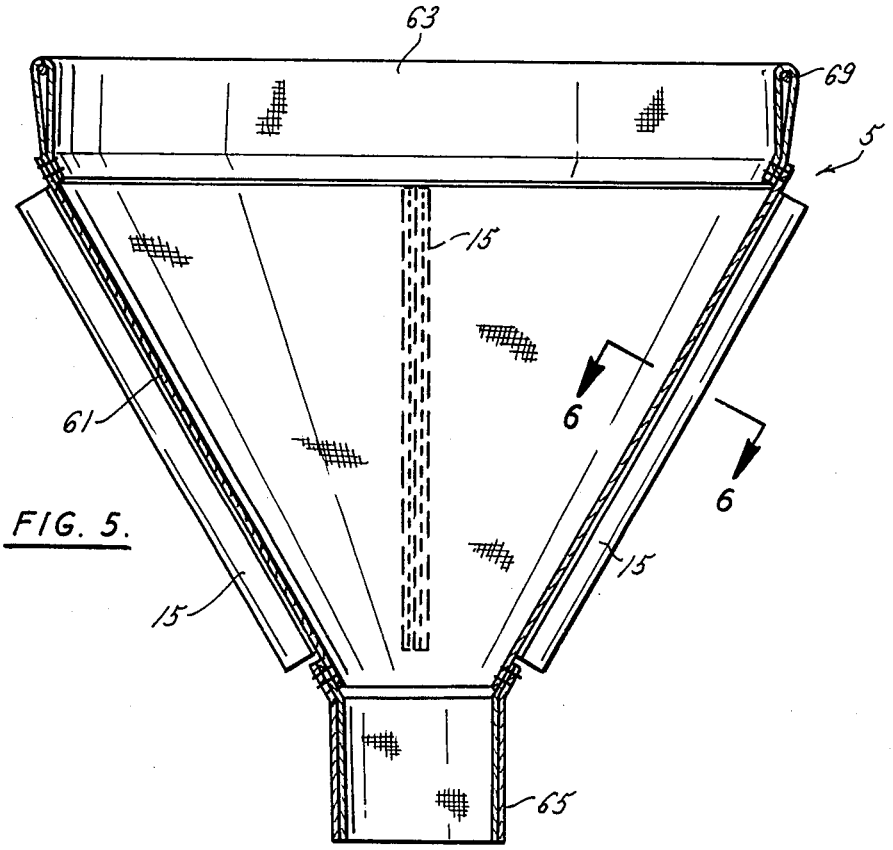
FIG. 5.
FIG. 6.
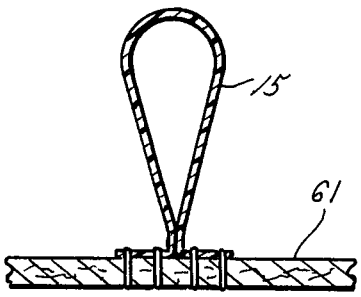
FIG. 6A.
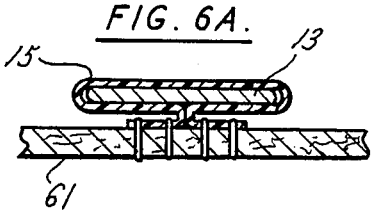

HOPPER SYSTEM AND CLAMPING ARRANGEMENT FOR A PERMEABLE MEMBRANE

BACKGROUND OF THE INVENTION

This invention relates generally to hopper systems adapted for storing fluent material within a hopper and fluidizing the material for efficient unloading of the material from the hopper.

This invention is especially concerned with hopper systems of the type wherein a permeable membrane closely overlies the side wall of a hopper for fluidized unloading of fluent material contained within the hopper. In such systems, the hopper walls have ports for introducing pressurized air into the hopper with the air passing inwardly through the membrane to increase the flowability of finely ground materials (e.g., flour) within the hopper. Hopper systems which utilize permeable membranes typically require maintenance and are difficult to repair due to the manner in which the membrane is attached to the hopper. For example, the membrane is typically fastened directly to the hopper (or a frame inside the hopper) by means of bolts passing through holes in the membrane, and tearing of the membrane is quite common at these holes. Replacement of a torn membrane can be difficult since each bolt retaining the membrane to the hopper must be removed and replaced. Moreover, access to the membrane and retaining bolts in the hopper can be quite limited thereby compounding the difficulty involved in replacing a membrane. In addition to securement to the hopper (or a frame inside the hopper) by means of bolts, the membranes are sometimes stitched to the members of a framework closely overlying the side wall of the hopper to reduce the tendency of the membrane to billow inwardly away from the side wall of the hopper upon introduction of pressurized air through the hopper walls and membrane into the interior of the hopper. Removing a used membrane from such a framework and installing a new membrane thereto can be difficult due to the extensive amount of stitching involved in securing the membrane to the individual members of the framework.

Reference may be made to U.S. Pat. Nos. 2,924,487, 3,115,369, and 3,448,900 showing a variety of hopper systems utilizing a permeable membrane secured to the inside of a hopper. Reference may also be made to U.S. Pat. Nos. 3,173,725, 3,253,750, 4,081,110, and 4,383,766 which disclose hopper systems generally in the field of this invention.

SUMMARY OF THE INVENTION

Accordingly, among the several objects of this invention may be noted the provision of an improved hopper system for storing fluent material in a hopper, such as flour, with provision for fluidized unloading of fluent material from the hopper; the provision of such a system which utilizes a permeable membrane secured on the inside of the hopper for fluidized unloading of the material; the provision of such a system wherein the membrane is secured in position without the need for holes therein; the provision of such a system wherein the memtrane may be readily installed in and removed from the hopper; and the provision of such a system wherein stiffeners for the membrane are readily applied to and removable from the membrane.

Generally, a hopper system of this invention comprises a hopper having an inlet at its upper end for loading fluent material into the hopper, an outlet at its lower end for unloading of fluent material from the hopper, a side wall, a membrane on the inside of the hopper having a shape generally conforming to the inside of the hopper and closely overlying the side wall of the hopper, the membrane being permeable to air but generally impermeable to fluent material in the hopper and having generally cylindric upper and lower ends, a port for introducing pressurized air into the hopper with the air passing inwardly through the membrane and into fluent material contained within the hopper thereby to fluidize the material for efficient unloading from the hopper, an upper clamping assembly adjacent the upper end of the hopper for clamping around the upper end of the membrane and securing it in fixed position with respect to the upper end of the hopper without the use of fasteners extending through holes in the end of the membrane, and a lower clamping assembly adjacent the lower end of the hopper for clamping around the lower end of the membrane and securing it in fixed position with respect to the lower end of the hopper without the use of fasteners extending through holes in the end of the membrane, the membrane being secured in position solely by the upper and lower clamping assemblies and being otherwise free of attachment to the hopper, thereby eliminating the need for attachment holes in the membrane.

Another aspect of this invention involves a hopper having an upper clamping assembly adjacent the upper end of the hopper for clamping around the upper end of the membrane and securing it in fixed position with respect to the upper end of the hopper and a lower clamping assembly adjacent the lower end of the hopper for clamping around the lower end of the membrane and securing it in fixed position with respect to the lower end of the hopper, the membrane being secured in position solely by the upper and lower clamping assemblies and being otherwise free of attachment to the hopper whereby the membrane may be readily removed from the hopper.

A further aspect of this invention involves a plurality of pockets on the membrane extending heightwise of the membrane and spaced at intervals around the membrane, and a plurality of stay bars received in the pockets, the stay bars being adapted for preventing substantial inward billowing of the membrane when pressurized air is introduced into the hopper.

Other objects and features of this invention will be in part apparent and in part pointed out hereinafter.

BRIEF DESCRIPTION OF THE DRAWINGS

FIG. 5 is an elevational view of a membrane used in the hopper system;

FIG. 6 is an enlarged sectional view on line 6—6 of FIG. 5 showing a pocket on the outside of the membrane;

FIG. 6A is a view similar to FIG. 6 showing a stay bar in the pocket;

Corresponding reference characters indicate corresponding parts throughout the several views of the drawings.

DESCRIPTION OF THE PREFERRED EMBODIMENT

Figure 1:
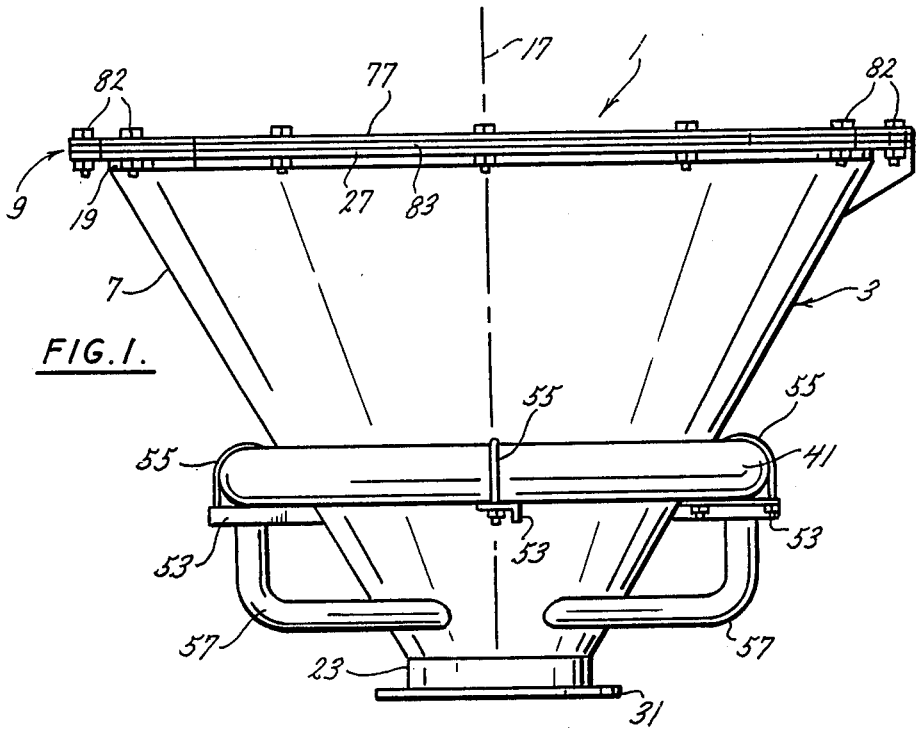
FIG. 1 is an elevation of the hopper system of this invention.
Figure 2:
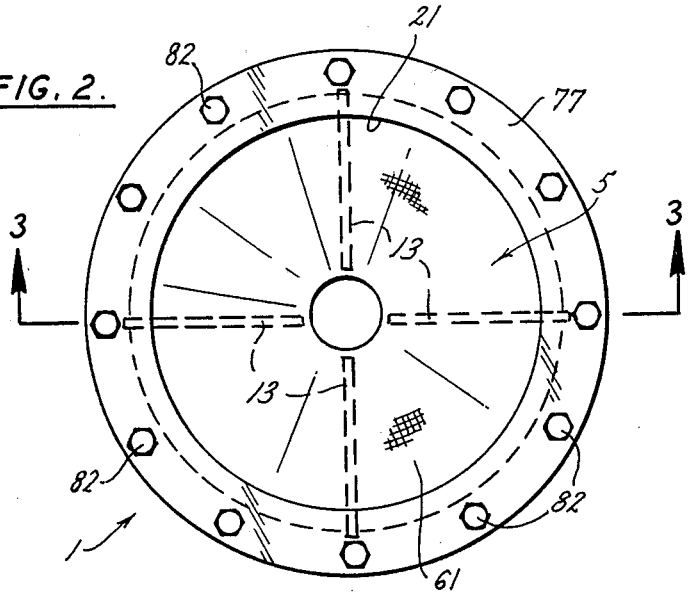
FIG. 2 is a top plan view of a FIG. 1 showing a permeable membrane on the inside of the hopper.
Figure 3:
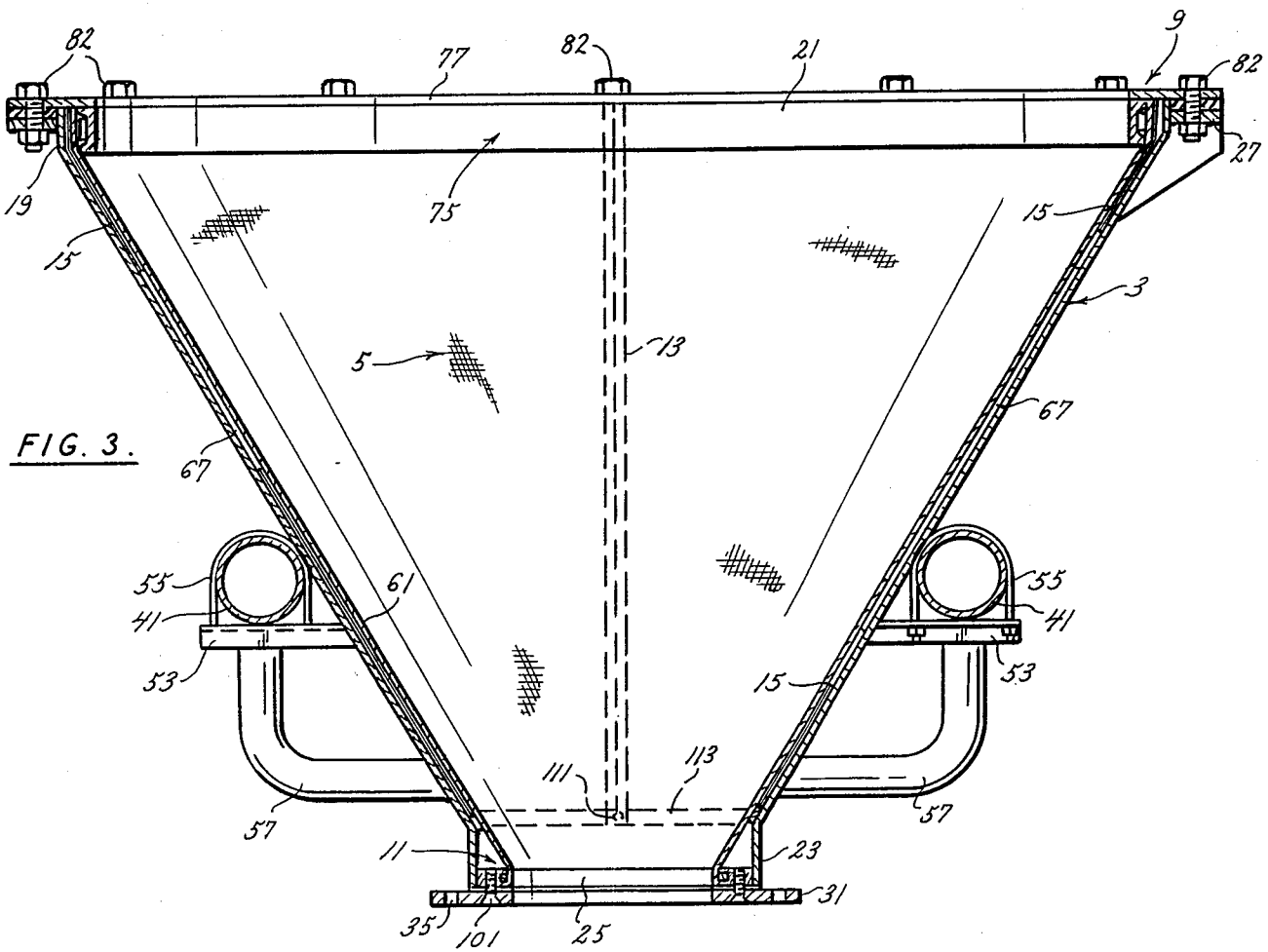
FIG. 3 is a vertical section taken on line 3—3 of FIG. 1, portions being broken away to illustrate details.
Figure 4:
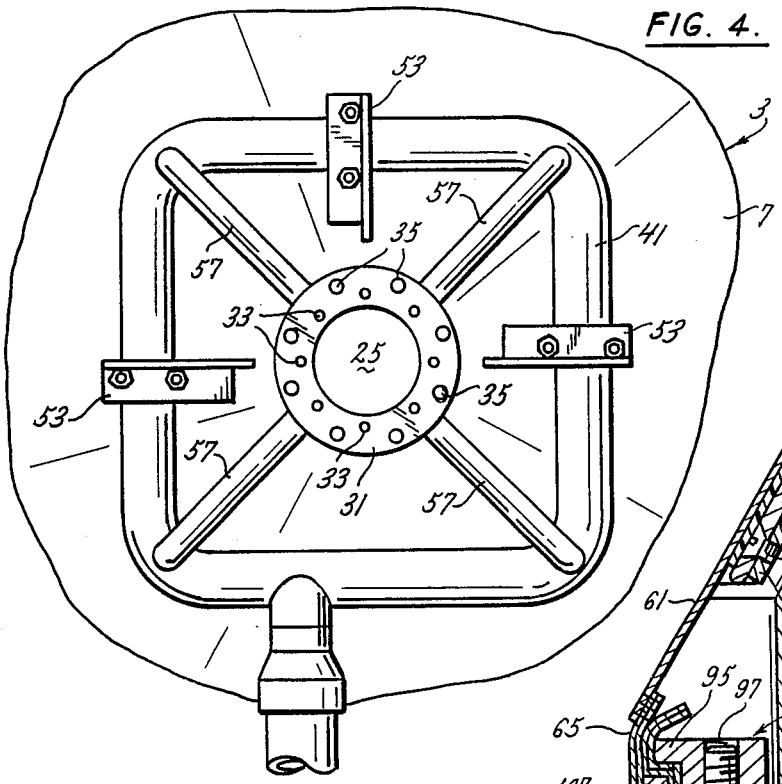
FIG. 4 is a bottom plan view of FIG. 1.

Referring now to the drawings, particularly FIGS. 1–3, a hopper system of this invention is designated in its entirety by the reference numeral 1. As illustrated, the system includes a conical hopper generally designated 3 for holding fluent material, such as flour. A permeable membrane, generally designated 5, having a funnel-shaped configuration generally corresponding to the shape of the inside of the hopper is secured in a position in which it closely overlies the funnel-shaped side wall 7 of the hopper. The annular upper end of the membrane is clamped in position by means of an upper clamping assembly generally designated 9 adjacent the upper end of the hopper and the annular lower end of the membrane is clamped in position by means of an annular lower clamping assembly generally designated 11 adjacent the lower end of the hopper 3. As will be explained, pressurized air is introduced into the hopper and passes inwardly through the membrane 5 and into fluent material contained within the hopper thereby to fluidize the material for efficient unloading from the hopper. Stay bars 13 received in a plurality of pockets 15 extending heightwise of the membrane prevent substantial inward billowing or pocketing of the membrane as air flows inwardly therethrough.

More specifically, the conical hopper 3 has a central vertical axis 17, a generally cylindric upper end 19 defining an inlet 21 for loading fluent material into the hopper, and a generally cylindric lower end 23 defining an outlet 25 for unloading fluent material from the hopper. The conical side wall 7 of the hopper slopes downwardly and radially inwardly for funneling fluent material in the hopper to the circular outlet 25 of the hopper. The hopper 3 has a peripheral flange 27 at its upper end to provide mounting for the upper clamping assembly 9, as will appear. Flange means in the form of an annular plate 31 is affixed to the lower end of the hopper in a generally horizontal position in which an inner portion of the plate lies radially inward of the lower end of the hopper and an outer portion lies radially outward of the lower end of the hopper. The inner portion has a plurality of holes 33 therein spaced at intervals around the plate and serves as a mounting for the lower clamping assembly 11. The outer portion has a plurality of holes 35 therein spaced at intervals around the plate to enable the plate to be fastened to an outlet valve for the hopper system.

A rectangular manifold 41 of circular cross section surrounds the hopper 3 and is adapted for receiving pressurized air from a suitable source (not shown). The manifold is supported by a plurality of angle supports, each designated 53, attached to the wall of the hopper (as by welding), the manifold being secured to the supports 53 by U-bolts 55. Pressurized air flows from the manifold into the hopper via a series of conduits 57 (e.g., four conduits extending from the corners of the manifold downwardly and inwardly to the hopper). The conduits 57 communicate at their upper ends with the manifold 41 and at their lower ends with the interior of the hopper at regularly spaced intervals around the hopper adjacent the lower end of the hopper. Air flowing into the hopper passes through the permeable membrane 5 into the material contained within the hopper to fluidize it.

As illustrated in FIG. 5, the membrane 5 has a generally conical central portion 61 corresponding in shape to the conical side wall 7 of the hopper and generally cylindric portions or skirts 63, 65 at its upper and lower ends, respectively. The central portion 61 is generally permeable to air but impermeable to fluent material in the hopper and may be, for example, a woven polyster or cotton fabric such as sold by C. R. Daniels, Inc. of Elliott City, Md. under the trade designation "Dandux Ayre-Flow Membrane". The central portion 61 of the membrane should be sufficiently dense that the flow of pressurized air into the hopper forces the membrane away from the hopper side wall 7 to form an annular plenum 67 enabling even distribution of air throughout the interior of the hopper from adjacent the upper end of the hopper to adjacent the lower end of the hopper. The upper and lower skirts 63, 65 of the membrane are preferably of double-thickness for greater strength and durability and are stitched to the central portion 61 of the membrane. For reasons which will appear, a circular rope or cord 69 is provided at the upper edge of the top skirt 63 between the thicknesses of the skirt.

As previously noted, the membrane 5 has a plurality of pockets 15 with stay bars 13 therein extending heightwise of the membrane on the outside thereof at suitable intervals around the membrane to prevent inward billowing or pocketing of the membrane which would otherwise tend to inhibit the flow of product out of the hopper. The stay bars 13 are free of any attachment to the upper and lower clamping assemblies 9, 11. For hoppers of relatively small diameter (e.g., two feet), four pockets may be sufficient; for hoppers of greater diameter (e.g., four-five feet), eight or more pockets may be needed. As shown in FIGS. 6 and 6A, the pockets 15 may be formed, for example, by stitching, gluing or otherwise attaching additional fabric (e.g., vinyl) to the outside surface of the membrane to form loops dimensioned to receive a stay bar 13, which may be a metal bar of rectangular section.

Figure 7:
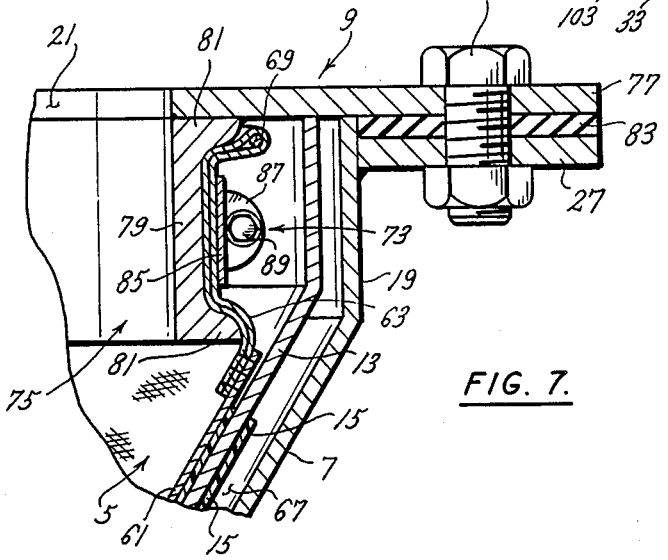
FIG. 7 is an enlarged portion of FIG. 3 showing an upper clamp assembly of the system.

As shown in detail in FIG. 7, the upper clamping assembly 9 includes a first upper clamping component in the form of a generally cylindric clamping member or ring generally indicated at 75 depending from the inner peripheral edge of an annular plate 77, the outer portion of which overlies the upper peripheral flange 27 of the hopper. The annular plate 77 mounts the clamping ring 75 in a position wherein it is disposed inside the hopper with its central axis generally coincident with the central vertical axis 17 of the hopper and with the ring spaced radially inwardly from the cylindric upper end 19 of the hopper. The ring 75 is generally channel-shaped in vertical cross-section, having a generally vertical web 79 and generally horizontal flanges 81 extending radially outwardly from the web. The ring 75 is rigidly affixed to the annular plate 77, as by welding. The annular plate is fastened by means of bolts 82 to the peripheral flange 27 at the upper end of the hopper. Thus, by removing the bolts 82, the plate 77 and ring 75 can be readily removed from the hopper as an integral unit. A gasket 83 disposed between plate 77 and flange 27 seals against leakage of pressurized air from the plenum 67.

The second upper clamping component 73 comprises a circular clamping band 85 adapted for clamping the upper skirt 63 of the membrane 5 against the ring 75. The band 85 encircles the ring 75 and is sufficiently narrow to fit between the flanges 81 of the ring. Adjoining ends of the clamping band are bent to form parallel, outwardly projecting flanges or tabs 87 joined by an adjusting screw 89 which enables the clamping band to be loosened and tightened relative to the clamping ring 75. Thus, by tightening the screw 89, the clamping band may be drawn toward the outwardly facing surface of the web 79 of ring 75 to securely clamp the upper skirt 63 of the membrane in place without the use of fasteners extending through holes in the fabric. The cord 69 at the upper edge of the upper skirt 63 prevents the membrane from slipping down and out from between the ring and the clamping band 85.

Figure 8:
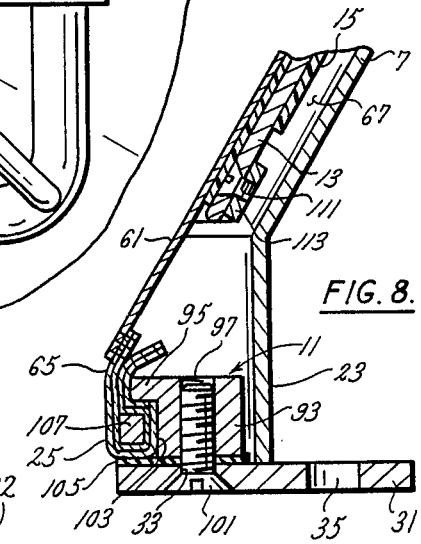
FIG. 8 is an enlarged portion of FIG. 3 showing a lower clamp assembly of the system.

FIG. 8 illustrates the lower clamping assembly 11 as comprising a first lower clamping component comprising a lower clamp ring 93 formed with a circular radial lip 95 projecting radially inwardly from the upper edge of the clamp ring. The clamp ring 93 has a series of vertical bores 97 therein spaced at intervals around its circumference corresponding to the holes 33 in plate 31. A plurality of screws 101 passing through bores 97 and holes 33 removably secure the lower clamp ring 93 to plate 31 in a position wherein the radial lip 95 is spaced above the plate thereby to define an annular recess 103 which is generally rectangular in vertical section. A gasket 105 is provided between the clamp ring and the plate to effect the appropriate seal.

The lower clamping assembly also includes a second lower clamping component comprising an annular member 107 which, as illustrated in FIG. 8, is receivable in the recess 103, the arrangement being such that the lower skirt 65 of the membrane 5 is adapted to pass under the annular member 107, up in the recess 103 between the annular member 107 and the lower clamp ring 93, and thence over the annular member and out of the recess to extend up on the outside of the membrane. The annular member 107 is so dimensioned relative to the recess 103 that, when screws 101 are tightened, the lower skirt 65 is securely and sealingly clamped between the lip 95 and the top of the annular member 107, and between the bottom of the annular member and lower plate 31 and gasket 105. The skirt is thus secured in fixed position with respect to the lower end of the hopper 3 without the use of fasteners extending through holes in the lower end of the membrane.

As shown best in FIGS. 7 and 8, the pockets 15 on the membrane 5 are open at their upper and lower ends for ready insertion and removal of the stay bars 13. The upper end of each stay bar projects upwardly, out of a respective pocket and is bent to extend vertically to a position abutting the annular plate 77. The lower end of each stay bar projects downwardly from its respective pocket for connection via a suitable fastener 111 to a circular mounting ring 113 inside the hopper. This ring 113 floats freely within the hopper (i.e., it is not attached to the hopper) but is sized to prevent substantial movement of the stay bars in the radial direction with respect to the hopper.

It will be apparent from the foregoing that the membrane is held in position within the hopper solely by the upper and lower clamping assemblies 9 and 11 and is otherwise free of attachment to the hopper 3, thereby completely eliminating the need for attachment holes in the membrane 5. Furthermore, the design is such that the plenum 67 surrounds substantially the entire surface of the membrane 5 to maximize the amount of material within the hopper which is fluidized.

Removal of the membrane 5 from the hopper 3 may readily be accomplished by removing the bolts 82 fastening the upper clamping assembly to the upper peripheral flange 27 of the hopper, and by removing the screws 101 securing the lower clamping assembly 11 to plate 31 at the outlet 25 of the hopper. The upper clamping assembly 9, with the upper skirt 63 of the membrane 5 clamped therein, and the lower clamping assembly 11, with the lower skirt 65 of the membrane clamped therein, may then be readily removed from the hopper 3 without unclamping the membrane. Once this entire assembly has been lifted from the hopper, the membrane 5 may then be unclamped from the upper clamping assembly by loosening the adjustable screw 89 thereby to loosen the grip of the circular clamping band 85 holding the upper skirt 63 against the web 79. Release of the lower skirt 65 may be accomplished by separating the annular member 107 from the lower clamping ring 93. A new membrane may be installed within the hopper by reversing the steps set forth above.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A hopper system adapted for storing fluent material and further adapted for fluidized unloading of fluent material from the system, comprising a hopper having an inlet at its upper end for loading fluent material into the hopper, an outlet at its lower end for unloading of fluent material from the hopper, a side wall, of funnel-shaped configuration, a membrane on the inside of the hopper having a funnel-shaped configuration generally conforming to the side wall of the hopper are closely overlying the side wall, said membrane being permeable to air but generally impermeable to fluent material in the hopper and having annular upper and lower ends, a port for introducing pressurized air into the hopper with the air passing inwardly through the membrane and into fluent material contained within the hopper thereby to fluidize the material for efficient unloading from the hopper, an upper annular clamping assembly adjacent the upper end of the hopper for clamping around the annular upper end of the membrane and securing it in fixed position radially inward from the side wall of the hopper at the upper end of the hopper without the use of fasteners extending through holes in the membrane, and a lower annular clamping assembly adjacent the lower end of the hopper for clamping around the annular lower end of the membrane and securing it in fixed position with respect to the lower end of the hopper without the use of fasteners extending through holes in the lower end of the membrane, said membrane being secured in position solely by said upper and lower annular clamping assemblies and being otherwise free of attachment to said hopper, thereby eliminating the need for attachment holes in the membrane, said lower clamping assembly being disposed only at the periphery of said hopper outlet so as not to inhibit unloading of fluent material from the hopper.

2. A hopper system adapted for storing fluent material and further adapted for fluidized unloading of fluent material from the system, comprising a hopper having an inlet at its upper end for loading fluent material into the hopper, an outlet at its lower end for unloading of fluent material from the hopper, a side wall, a membrane on the inside of the hopper having a shape generally conforming to the inside of the hopper and closely overlying the side wall of the hopper, said membrane being permeable to air but generally impermeable to fluent material in the hopper and having generally cylindric ends at its upper and lower ends, a port for introducing pressurized air into the hopper with the air passing inwardly through the membrane and into fluent material contained within the hopper thereby to fluidize the material for efficient unloading from the hopper, an upper clamping assembly adjacent the upper end of the hopper for clamping around the upper end of the membrane and securing it in fixed position with respect to the upper end of the hopper withcut the use of fasteners extending through holes in the upper end of the membrane, the upper clamping assembly comprising a first upper clamping component including an upper generally cylindric clamping member having a diameter less than the inside diameter of the hopper at its upper end, and means for removably mounting said first upper clamping component on the hopper in a position wherein said cylindric clamping member is disposed inside the hopper with the central axis of the clamping member generally vertical and with the clamping member spaced inwardly from the side wall of the hopper adjacent the upper end of the hopper, and a second clamping component comprising a circular clamping band adjustable for clamping the upper end of the membrane against said cylindric clamping member, and a lower clamping assembly adjacent the lower end of the hopper for clamping around the lower end of the membrane and securing it in fixed position with respect to the lower end of the hopper without the use of fasteners extending through holes in the lower end of the membrane, said membrane being secured in position solely by said upper and lower clamping assemblies and being otherwise free of attachment to said hopper, thereby eliminating the need for attachment holes in the membrane.

3. A hopper system as set forth in claim 2 wherein said cylindric clamping member is generally channel-shaped in cross section with a generally vertical web and generally horizontal flanges, said clamping band having a width less than the distance between said flanges and being receivable therebetween for clamping the upper end of the membrane against the web of the cylindric clamping member.

4. A hopper system as set forth in claim 1 further comprising means adjacent the upper edge of the membrane for preventing the membrane from slipping down from between said first and second clamping components.

5. A hopper system adapted for storing fluent material and further adapted for fluidized unloading of fluent material from the system, comprising a hopper having an inlet at its upper end for loading fluent material into the hopper, an outlet at its lower end for unloading of fluent material from the hopper, a side wall, a membrane on the inside of the hopper having a shape generally conforming to the inside of the hopper and closely overlying the side wall of the hopper, said membrane being permeable to air but generally impermeable to fluent material in the hopper and having generally cylindric ends at its upper and lower ends, a port for introducing pressurized air into the hopper with the air passing inwardly through the membrane and into fluent material contained within the hopper thereby to fluidize the material for efficient unloading from the hopper, an upper clamping assembly adjacent the upper end of the hopper for clamping around the upper end of the membrane and securing it in fixed position with respect to the upper end of the hopper without the use of fasteners extending through holes in the upper end of the membrane, flange means at the lower end of the hopper, and a lower clamping assembly comprising first and second lower clamping components disposed above said flange means inside the hopper for clamping the lower end of the membrane therebetween, said first lower clamping component being removably attached to said flange means, the lower clamping assembly being adjacent the lower end of the hopper for clamping around the lower end of the membrane and securing it in fixed position with respect to the lower end of the hopper without the use of fasteners extending through holes in the lower end of the membrane, said membrane being secured in position solely by said upper and lower clamping assemblies and being otherwise free of attachment to said hopper, thereby eliminating the need for attachment holes in the membrane.

6. A hopper system as set forth in claim 5 wherein said first lower clamping component comprises a lower clamp ring formed with a circular radial lip, said lower clamp ring being adapted to be attached atop said flange means with said lip spaced above said flange means thereby to define an annular recess therebetween, said second lower clamping component comprising an annular member receivable in said recess, the arrangement being such that the lower end of the membrane is adapted to pass under said annular member, up in said recess between the annular member and the lower clamp ring, and thence over the annular member and out of the recess, and means for drawing said lower clamp ring down toward said flange means thereby to clamp the membrane between said lip and the top of the the annular member and between the bottom of the annular member and said flange means.

7. A hopper system as set forth in claim 1 further comprising a plurality of pockets on the membrane extending heightwise of the membrane and spaced at intervals around the membrane, and a plurality of stay bars received in the pockets, said stay bars being adapted for preventing substantial inward billowing of the membrane when pressurized air is introduced into the hopper.

8. A hopper system adapted for storing fluent material and further adapted for fluidized unloading of fluent material from the system, comprising a hopper having an inlet at its upper end for loading fluent material into the hopper, an outlet at its lower end for unloading of fluent material from the hopper, a side wall, a membrane on the inside of the hopper having a shape generally conforming to the inside of the hopper and closely overlying the side wall of the hopper, said membrane being permeable to air but generally impermeable to fluent material in the hopper and having generally cylindric ends at its upper and lower ends, a port for introducing pressurized air into the hopper with the air passing inwardly through the membrane and into fluent material contained within the hopper thereby to fluidize the material for efficient unloading from the hopper, an upper clamping assembly adjacent the upper end of the hopper for clamping around the upper end of the membrane and securing it in fixed position with respect to the upper end of the hopper without the use of fasteners extending through holes in the upper end of the membrane, and a lower clamping assembly adjacent the lower end of the hopper for clamping around the lower end of the membrane and securing it in fixed position with respect to the lower end of the hopper without the use of fasteners extending through holes in the lower end of the membrane, said membrane having a plurality of pockets on it extending heightwise of the membrane and spaced at intervals around the membrane, and a plurality of stay bars received in the pockets, each said pocket being open at its upper end for ready insertion and removal of a stay bar into and from the pocket, said stay bars being adapted for preventing substantial inward billowing of the membrane when pressurized air is introduced into the hopper, said membrane being secured in position solely by said upper and lower clamping assemblies and being otherwise free of attachment to said hopper, thereby eliminating the need for attachment holes in the membrane.

9. A hopper system as set forth in claim 8 wherein the lower end of each pocket is open and each stay bar projects downwardly therefrom for connection to a mounting ring disposed inside the hopper around the outside of said membrane, said mountirg ring being free of connection to the hopper side wall so that it floats freely within the hopper.

10. A hopper system adapted for storing fluent material and further adapted for fluidized unloading of fluent material from the system, comprising a hopper having an inlet at its upper end for loading fluent material into the hopper, an outlet at its lower end for unloading fluent material from the hopper, a side wall sloping downwardly and inwardly for funneling fluent material in the hopper to the outlet of the hopper, a membrane on the inside of the hopper having a shape generally conforming to the inside of the hopper and closely overlying the side wall of the hopper, said membrane being permeable to air but generally impermeable to fluent material in the hopper, a port for introducing pressurized air into the hopper with the air passing inwardly through the membrane and into fluent material contained within the hopper thereby to fluidize the material for efficient unloading from the hopper, characterized in that said system comprises an upper clamping assembly adjacent the upper end of the hopper for clamping around the upper end of the membrane and securing it in fixed position with respect to the upper end of the hopper, said upper clamping assembly comprising a first upper clamping component including an upper generally cylindric clamping member having a central axis and a diameter less than the inside diameter of the hopper at its upper end, means mounting said first upper clamping component on the hopper in a position wherein said cylindric clamping member is disposed inside the hopper with the central axis of the clamping member generally vertical and with the clamping member spaced inwardly from the side wall of the hopper adjacent the upper end of the hopper, and a second upper clamping component comprising a circular clamping band adjustable for clamping the upper edge margin of the membrane against the cylindric clamping member, and a lower clamping assembly adjacent the lower end of the hopper for clamping around the lower end of the membrane and securing it in fixed position with respect to the lower end of the hopper, said lower clamping assembly comprising first and second lower clamping components adapted for clamping the lower edge margin of the membrane therebetween in fixed position relative to the hopper, said membrane being secured in position solely by said upper and lower clamping assemblies and being otherwise free of attachment to said hopper whereby said membrane may be readily removed from the hopper.

11. A hopper system as set forth in claim 10 wherein said first upper clamping component is removably mounted on the hopper.

12. A hopper system as set forth in claim 10 wherein said cylindric clamping member is generally channel-shaped in cross section with a generally vertical web and generally horizontal flanges, said clamping band having a width less then the distance between said flanges and being receivable therebetween for clamping the upper end of the membrane against the web of the cylindric clamping member.

13. A hopper system as set forth in claim 10 further comprising means adjacent the upper edge of the membrane for preventing the membrane from slipping down from between said first and second clamping components.

14. A hopper system as set forth in claim 10 further comprising flange means at the lower end of the hopper, said lower clamping assembly comprising first and second lower clamping components disposed above said flange means inside the hopper for clamping the lower end of the membrane therebetween, said first lower clamping component being removably attached to said flange means.

15. A hopper system as set forth in claim 14 wherein said first lower clamping component comprises a lower clamp ring formed with a circular radial lip, said lower clamp ring being adapted to be attached atop said flange means with said lip spaced above said flange means to define an annular recess therebetween, said second lower clamping component comprising an annular member receivable in said recess, the arrangement being such that the lower end of the membrane is adapted to pass under said annular member, up in said recess between the annular member and the lower clamp ring, and thence over the annular member and out of the recess, and means for drawing said lower clamp ring down toward said flange means thereby to clamp the membrane between said lip and the top of the the annular member and between the bottom of the annular member and said flange means.

16. A hopper system as set forth in claim 10 further comprising a plurality of pockets on the membrane extending heightwise of the membrane and spaced at intervals around the membrane, and a plurality of stay bars received in the pockets, said stay bars being adapted for preventing substantial inward billowing of the membrane when pressurized air is introduced into the hopper.

17. A hopper system as set forth in claim 16 wherein each pocket is open at its upper end for ready insertion and removal of a stay bar into and from the pocket.

18. A hopper system adapted for storing fluent material and further adapted for fluidized unloading of fluent material from the system, comprising a hopper having an inlet at its upper end for loading fluent material into the hopper, an outlet at its lower end for unloading of fluent material from the hopper, a side wall sloping downwardly and inwardly for funneling fluent material in the hopper to the outlet of the hopper, a membrane on the inside of the hopper having a shape generally conforming to the inside of the hopper and closely overlying said side wall of the hopper, said membrane being permeable to air but generally impermeable to fluent material in the hopper, a port for introducing pressurized air into the hopper with the air passing inwardly through the membrane and into fluent material contained within the hopper thereby to fluidize the material for efficient unloading from the hopper, characterized in that said system comprises an upper clamping assembly on the inside of the hopper adjacent its upper end for clamping around the upper end of the membrane and securing it in fixed position with respect to the upper end of the hopper, a lower clamping assembly on the inside of the hopper adjacent its lower end for clamping around the lower end of the membrane and securing it in fixed position with respect to the lower end of the hopper, a plurality of pockets on the membrane extending heightwise of the membrane and spaced at intervals around the membrane, and a plurality of stay bars received in the pockets, said stay bars being free of attachnent to said upper and lower clamping assemblies and adapted for preventing substantial inward billowing of the membrane when pressurized air is introduced into the hopper.

19. A hopper system adapted for storing fluent material and further adapted for fluidized unloading of fluent material from the system, comprising a hopper having an inlet at its upper end for loading fluent material into the hopper, an outlet at its lower end for unloading of fluent material from the hopper, a side wall sloping downwardly and inwardly for funneling fluent material in the hopper to the outlet of the hopper, a membrane on the inside of the hopper having a shape generally conforming to the inside of the hopper and closely overlying said side wall of the hopper, said membrane being permeable to air but generally impermeable to fluent material in the hopper, a port for introducing pressurized air into the hopper with the air passing inwardly through the membrane and into fluent material contained within the hopper thereby to fluidize the material for efficient unloading from the hopper, characterized in that said system comprises an upper clamping assembly on the inside of the hopper adjacent its upper end for clamping around the upper end of the membrane and securing it in fixed position with respect to the upper end of the hopper, a lower clamping assembly on the inside of the hopper adjacent its lower end for clamping around the lower end of the membrane and securing it in fixed position with respect to the lower end of the hopper, a plurality of pockets on the membrane extending heightwise of the membrane and spaced at intervals around the membrane, and a plurality of stay bars received in the pockets, each said pocket being open at its upper end for ready insertion and removal of a stay bar into and from the pocket, said stay bars being adapted for preventing substantial inward billowing of the membrane when pressurized air is introduced into the hopper.

20. A hopper system as set forth in claim 19 wherein said hopper and membrane are generally conical in shape, said membrane having a generally cylindric upper end and a generally cylindric lower end.

* * * * *

UNITED STATES PATENT AND TRADEMARK OFFICE

CERTIFICATE OF CORRECTION

PATENT NO. : 4,848,975

DATED : July 18, 1989

INVENTOR(S) : Charles S. Alack

It is certified that error appears in the above-identified patent and that said Letters Patent is hereby corrected as shown below:

Column 6, line 44, "hopper are closely", should read ---hopper and closely---.

Column 9, line 30, "mountirg ring", should read ---mounting ring---.

Signed and Sealed this

Twenty-second Day of January, 1991

*Attest:*

HARRY F. MANBECK, JR.

*Attesting Officer*

*Commissioner of Patents and Trademarks*